United States Patent [19]

Umeda et al.

[11] Patent Number: 4,483,418

[45] Date of Patent: Nov. 20, 1984

[54] ELEVATOR CONTROL SYSTEM

[75] Inventors: Yasukazu Umeda; Shinobu Tajima; Toshiyuki Kamohara, all of Inazawa, Japan

[73] Assignee: Mitsubishi Denki Kabushiki Kaisha, Tokyo, Japan

[21] Appl. No.: 401,989

[22] Filed: Jul. 26, 1982

Related U.S. Application Data

[63] Continuation-in-part of Ser. No. 214,432, Dec. 8, 1980, abandoned.

[30] Foreign Application Priority Data

| | | | |
|---|---|---|---|
| Dec. 17, 1979 | [IT] | Italy | 68928 A/80 |
| Dec. 17, 1979 | [JP] | Japan | 54-163725 |
| Dec. 17, 1979 | [GB] | United Kingdom | 8040414 |

[51] Int. Cl.[3] ..... B66B 1/18

[52] U.S. Cl. ..... 187/29 R; 364/900

[58] Field of Search ..... 187/29; 364/200, 900

[56] References Cited

U.S. PATENT DOCUMENTS

| | | | |
|---|---|---|---|
| 4,047,596 | 9/1977 | Winkler | 187/29 |
| 4,166,518 | 9/1979 | Nakazato et al. | 187/29 |
| 4,193,478 | 3/1980 | Keller et al. | 187/29 |
| 4,266,632 | 5/1981 | Yoneda et al. | 187/29 |
| 4,288,859 | 9/1981 | Zeindler et al. | 364/900 |

FOREIGN PATENT DOCUMENTS

| | | | |
|---|---|---|---|
| 54-6264 | 1/1979 | Japan | 187/29 |

*Primary Examiner*—G. Z. Rubinson
*Assistant Examiner*—W. E. Duncanson, Jr.
*Attorney, Agent, or Firm*—Wenderoth, Lind & Ponack

[57] ABSTRACT

An elevator control system includes an ROM device having control data common to all elevator cars stored therein, and a setting device having a plurality of switches which are selectively closed and opened to designate the ordinal binary numbers of floors of a building served by an associated elevator car. When the building has many floors, the setting device may similarly designate the ordinal binary number of the lower ten floors and those of the remaining floors are additionally stored in the ROM device.

4 Claims, 4 Drawing Figures

ELEVATOR CONTROL SYSTEM

CROSS REFERENCE TO RELATED APPLICATIONS

This application is a continuation-in-part of now abandoned U.S. application Ser. No. 214,432, now abandoned filed Dec. 8, 1980.

BACKGROUND OF THE INVENTION

This invention relates to improvements in an elevator control system employing an electronic computer.

Electronic computers are starting to be used to control elevator cars. Elevator control systems employing an electronic computer include a read only memory device (which is abbreviated hereinafter as a "ROM") having stored therein data used with a program for controlling an associated elevator system. However, the ROM devices included in conventional elevator control systems have been required to store data peculiar to a mating elevator car because a building served by that elevator car may be different from other buildings in both the number of floors at which the elevator cars thereof stop and the vertical distance between each pair of adjacent floors. This has not only resulted in an expensive ROM device but also in the disadvantage that, upon the occurrence of a failure of the ROM device, an associated elevator car cannot again be operated unless the failed ROM device is exchanged for a new ROM device having stored therein data peculiar to that elevator system.

Alternatively, the required data may be rewritten into a ROM device at the location where the elevator car is installed. However, this measure is uneconomical only because the required writing and screening devices are expensive and the writing into the ROM device also consumes a fairly long period of time. Therefore, time elapses until the operation of the elevator system can be restored. Furthermore, if a new ROM device is produced in an associated factory, a considerable period of time must be anticipated for the necessary procedure, the transportation of the components, etc. As a result, the operation of the elevator car cannot be expected to be quickly restored.

Accordingly, it is an object of the present invention to eliminate the disadvantages of the prior art practice as described above by the provision of a new and improved elevator control system in which, upon the occurrence of a failure of its ROM device, the time interval required to restore the elevator operation is as short as possible. Another object of the present invention is to design an elevator system which can be more cheaply constructed than a conventional elevator control system having an electronic computer.

SUMMARY OF THE INVENTION

The present invention provides a system for controlling an elevator arrangement having an elevator car and employing an electronic computer, comprising an ROM device having stored therein first control data common to general elevator cars, and a setting device disposed separately from the ROM device and including a plurality of control elements each selectively providing an ON and an OFF signal, the setting device setting second control data peculiar to the specific associated elevator car by combining the ON and OFF signals from the plurality of control elements in a predetermined manner.

Each of the control elements may preferably comprise a switch which can be selectively placed in one of either its closed or open positions so as to selectively provide the respective ON and OFF signals.

Advantageously, the setting device may set the values of second control data lying within a predetermined range and the ROM device may have stored therein the values of second control data lying outside of the predetermined range.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
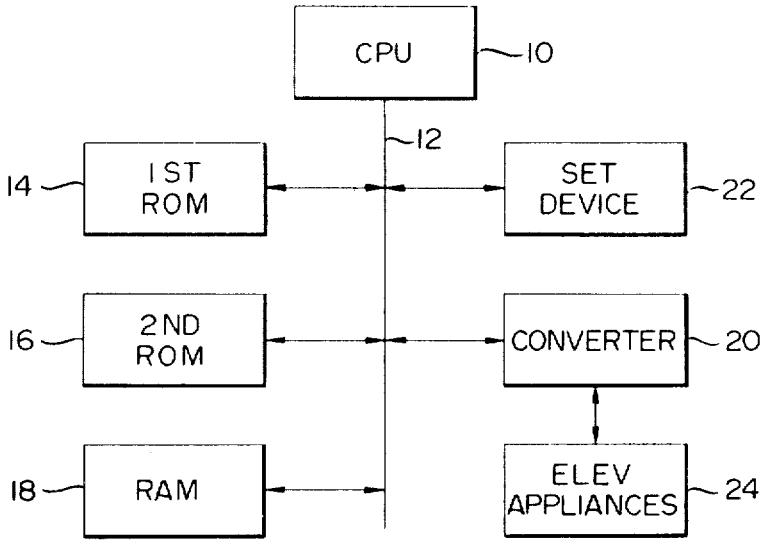
FIG. 1 is a block diagram of one embodiment according to the elevator control system of the present invention.

Referring now to FIG. 1 of the drawing, there is illustrated one embodiment according to the elevator control system of the present invention. The illustrated arrangement comprises a central processing unit 10 which may comprise a single chip 8-bit microprocessor which is commercially available as Part No. 8085A, manufactured by the Intel Corporation, and a signal lead 12 extending from the central processing unit 10 and representing a group of signal lines such as address busses, data busses, control busses, etc. The arrangement further comprises a first ROM device 14, a second ROM device 16, a random access memory device 18 (which is abbreviated hereinafter as a "RAM"), a converter 20 and a setting device 22, each connected to the lead 12 so as to receive and transmit data from and to the lead 12. The converter 20 is connected to a controlled object 24 or elevator's appliances disposed in an associated elevator car and on floors of a building served by that car so as to transmit and receive data to and from thc latter, (the elevator car and floors are not illustrated—for simplicity).

The first ROM device 14 has stored therein a program for controlling the elevator car and may comprise a 16K UV erasable PROM device which is commercially available as Part No. 2716 from the Intel Corporation. According to the present invention, control data used with the program is divided into first data common to general elevator cars and second data peculiar to the associated elevator car. The second ROM device 16 has stored therein the first control data common to all the elevator cars as described above and may also comprise a 16K UV erasable PROM device which is commercially available as Part No. 2716 from the Intel Corporation. The second control data peculiar to the elevator car is set by the setting device 22 as will be described later.

Only when the RAM device 18 is maintained energized from an associated electric source, is data stored and held therein. The RAM device 18 may comprise a static MOS RAM device which is commercially available as Part No. 2114 from the Intel Corporation.

The converter 20 is operative to convert data from one of either the central processing unit 10 or the elevator's appliances 24 to data suitable for use with the other of the two and to supply the converted data to the latter. The converter 20 may convert a voltage level to another voltage level, and analog signal to a corresponding digital signal or a serial signal to a parallel signal as the case may be.

Figure 2:
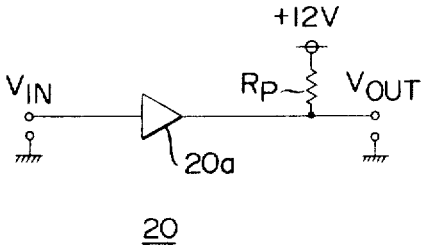
FIG. 2 is a circuit diagram of one embodiment of the converter shown in FIG. 1.

The converter 20 may be fabricated from a commercially available integrated circuit such as Part No. SN 7407 from the Texas Instruments Corporation and is preferably of a circuit configuration as shown in FIG. 2. The illustrated arrangement comprises a buffer 20*a* having its input connected to an input terminal $V_{in}$ and having its output connected to both an output terminal $V_{out}$ and also through a resistor $R_P$ to a positive terminal of a 12 volt DC voltage source.

When the input terminal $V_{in}$ receives a high level signal, for example, 5 volts, the output terminal $V_{out}$ is set at a voltage level of 12 volts. On the other hand, when the input terminal $V_{in}$ receives a low level signal, for example, 0 volts, the output terminal $V_{out}$ is set at a zero voltage level.

In this way, an ON-OFF signal having a 5 volt Swing is voltage-converted to an ON-OFF signal having a 12 volt Swing.

In a similar fashion, an ON-OFF signal having a 12 volt Swing can be converted to an ON-OFF signal having a 5 volt Swing by a converter which is fundamentally similar to the converter 20 described above. Therefore, such a similar converter is not described in detail herein.

From the foregoing it is seen that the central processing unit 10 normally controls the elevator's appliances 24 according to the program stored in the first ROM device 14 through the converter 20 while at the same time calculating data read out from the second ROM device 16 by utilizing data read out from the RAM device 18 and controlling the elevator's appliances 24 in accordance with the result of the calculaton through the converter 20.

Figure 4:
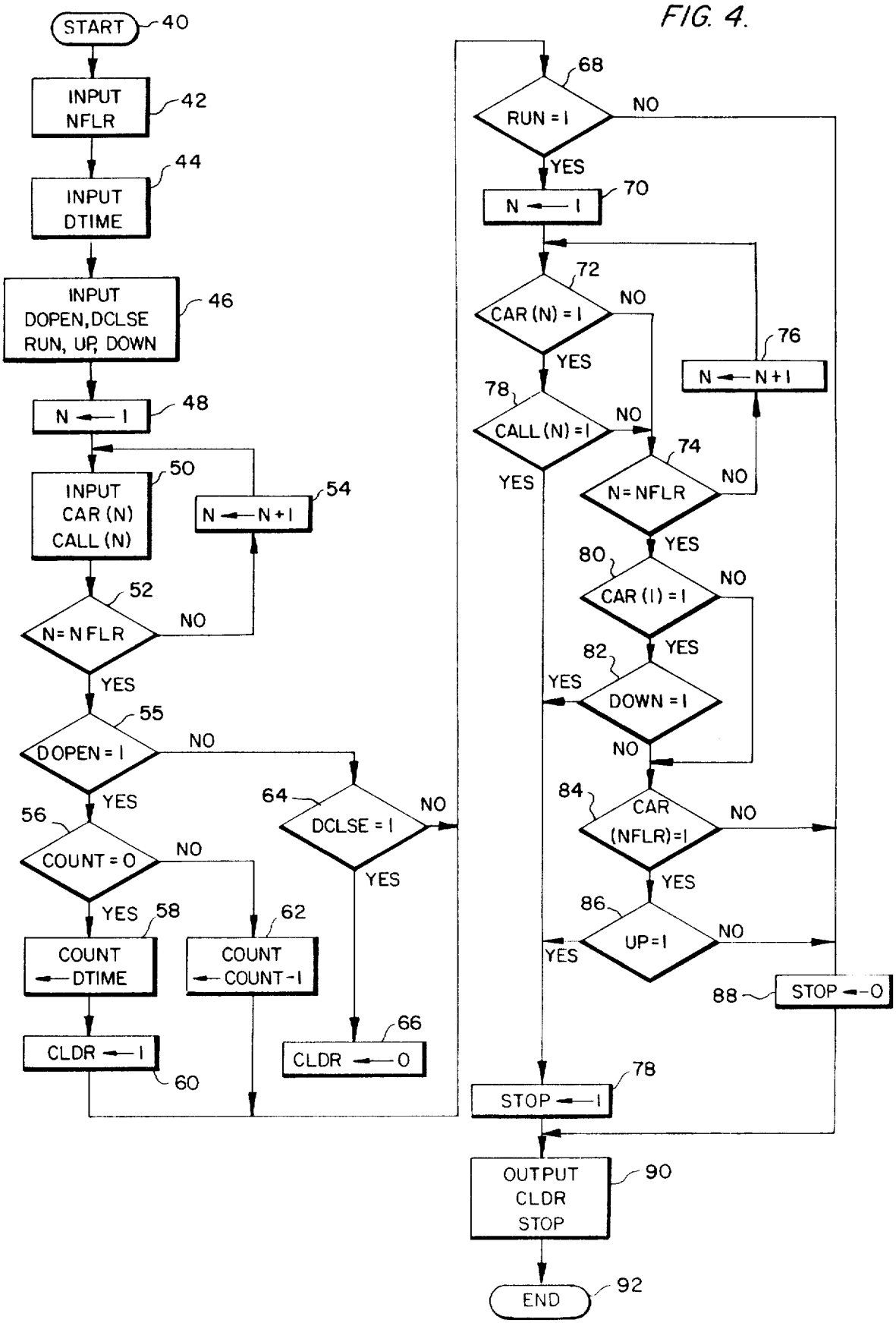
FIG. 4 is a flow chart illustrating a program executed by the central processing unit shown in FIG. 1.

The operation of the central processing unit 10 will now be described, particularly in conjunction with the closure of doors and the determination of that floor at which the elevator car is to be stopped, and with reference to FIG. 4 and Table I. In FIG. 4 there is illustrated a flow chart showing a program stored in the first ROM device 14 and executed by the central processing unit 10 every 0.1 second under the control of a control device, which may comprise the commercially available Part No. 8155 2k bit static MOSRAM with I/O ports and timer, manufactured by the Intel Corporation.

The program which is started at step 40 is entered in step 42, wherein a signal "NFLR" which indicates the number of the floors served by the elevator car is entered into the RAM device 18 from the set device 22, as will be described later in detail, and is stored in the RAM device 18. It is assumed that the signal "NFLR" has a binary value of "1010" because ten floors are served by the elevator car.

At the next succeeding step 42, a door opening time "DTIME" from the second ROM device 16 is entered into and stored in the RAM device 18. The door opening time is common to all the elevator cars and assumed to be of a value 40 which corresponds to four seconds. Thus, the RAM device 18 has stored therein a binary number corresponding to the decimal number 40 as the door opening time DTIME. Thereafter, step 44 initiates the read out of signals for the completion of the opening of the doors "DOPEN", signals for the completion of a closure of the doors "DCLSE", a running signal "RUN" and an up signal "UP" and a down signal "DOWN" from the elevator appliances 24 through the converter 20, and step 44 further initiates the storage of such signals in the RAM device 18. Each of these signals is stored in the RAM device 18 with a binary ONE for a corresponding output level of zero volts from the converter 20 and with a binary ZERO for a corresponding output level of five volts from the converter 20.

Subsequently, in order to enable the storage in the RAM device 18 of that floor at which the elevator car is present and further enables the storage of which of the floors has a call present or registered thereat, step 48 first specifies the first floor by imparting ONE(1) to the floor number N.

In the next succeeding step 50, the RAM device 18 stores therein signals "CAR(1)" and "CALL(1)" for indicating the presence or the absence of the elevator car and call at the first floor. When the car and call are present at the first floor, each of those signals is of a binary ONE and otherwise, those signals are of a binary ZERO. Generally, the signals "CAR(N)" and "CALL(N)" refer to those signals at the N-th floor. Then, in step 52, it is determined if the ordinal number of the specified floor is equal to the number NFLR of the floor. In this case, since the first floor is specified, step 52 gives an answer "NO", after which a value of one(1) is added to the specified number or one(1) in step 54. Then, steps 50 and 52 are repeated with a number equal to two (2). Steps 50 and 52 are repeated with a value of one (1) being successively added to the just preceding number in step 54 until step 52 indicates the storage of the signals "CAR(N)" and "CALL(N)" at all of the floors in the RAM device 18. In the illustrated example, step 52 gives an answer "YES" after the signals "CAR(10) and "CALL(10)" at the tenth floor have been stored in the RAM device.

Following this, step 54 is entered to initiate the control of the closure of the doors by using the data stored in the RAM device 18.

More specifically, step 55 determines if the opening of the doors was completed. That is to say, if the signal for the completion of opening of the doors "DOPEN" is a binary one. If so, as determined by step 55, then step 56 determines if a count stored by an associated timer is equal to zero. When the timer has a zero count, as determined by step 56, step 58 is entered, wherein the count in the timer is set to a specified magnitude "DTIME"; after which, step 60 produces a command closure-of-doors signal "CLDR" having a value of binary ONE. Thus, the process passing through the steps 56, 58, and 60 sets the door opening time to four seconds and equal to the program period of 0.1 second multiplied by the door opening time of 40, as described above, and produces the command closure-of-doors signal at a time equal to four seconds after the opening of the doors has been completed.

If the count on the timer is not equal to zero, as determined by step 56, then a value of ONE(1) is subtracted from the count in the timer in step 62.

When the closure of the doors has been completed with the command closure-of-doors signal "CLDR", step 54 goes to step 64 and then to step 66, where the command closure-of-doors signal "CLDR" has a value of binary ZERO.

If the doors are being closed, step 64 determines that the signal for the completion of the closure of the doors is not a binaray ONE so that step 64 goes to step 68.

Each of steps 60,62, and 66 goes to step 64.

Step 46 is intitated to stop the elevator car at that floor having a call registered or present thereat. More specifically, step 68 determines if the elevator car is traveling, that is to say, if the running signal "RUN" is a binary ONE. If so, as determined by step 68, then step 70 first specifies the first floor as step 54.

This is followed by the determination of that floor at which the elevator car is present and the determination of which of the floors has a call presented thereat. First, step 72 determines if the elevator car is at the first floor, that is to say, if the signal "CAR(1)" is a binary ONE. Step 72 and steps 74 and 76, which are identical to steps 52 and 54, are respectively repeated until step 72 determines that the elevator car is present at the N-th floor. Then, step 78 determines if a call is present at the N-th floor, that is to say, if the signal "CALL(N)" is a binary ONE. Similarly, step 74, 76, 72 and 78 are repeated until the call is presented at the N-th floor as determined by step 78. Thus, it has been determined that the call is presented or registered at that floor at which the elevator car is present. At that time, step 78 is entered to impart a binary ONE to a stopping signal "STOP" which corresponds to a command deceleration signal.

When the call is not registered at that floor at which the elevator car is present, after the determination has been effected with all the floors, it is not normally required to stop the elevator car. However, the program additionally includes steps 80 through 86 for the purpose of security. It is assumed that step 80 determines that the elevator car is present at the first floor, that is to say, that the car position signal is a binary ONE. Under the assumed conditions, step 82 determines that the elevator car is in the down direction, or that the down signal "DOWN" is a binary ONE. Alternatively, step 84 determines that the elevator car is present at the highest floor, or that a signal CAR(NFLR) is a binary ONE and step 86 determines that the elevator car is in the up direction or that the up signal "UP" is a binary ONE. Under these circumstances, step 78 is entered without a call. This is because there is a danger unless the elevator car is stopped.

Otherwise, step 88 is entered so as to set the stopping signal "STOP" to a binary ZERO and then goes to step 90. Step 98 also goes to step 96.

If step 68 determines that the elevator car is not in the up direction, then the program goes directly to step 88.

Step 90 delivers both the command closure-of-doors signal and the calculated stopping signal, as described above. Those signals are applied to the converter 20 to be converted to signals having a 12 volt swing and then are supplied to various circuits, such as the motor circuits for closing the doors, the braking circuit for decelerating the elevator car, etc., said circuits included in the elevator appliances 24 and not described herein.

The program is ended at step 92 and then again started with step 40 after a lapse of 0.1 second measured from the commencement of the program as described above, since the program has a period of 0.1 second, as described above.

The present invention is further characterized by the setting device 22 which will be subsequently described.

Figure 3:
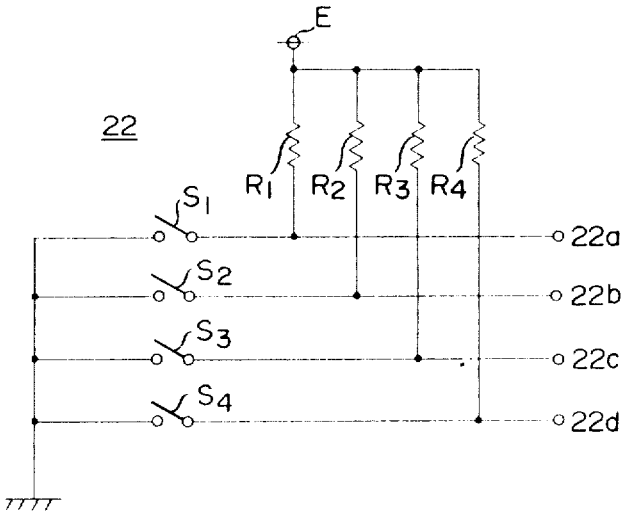
FIG. 3 is a circuit diagram of the one embodiment of the setting device shown in FIG. 1.

The setting device 22 is preferably of a circuit configuration as shown in FIG. 3. In the illustrated arrangement, a plurality of normally open switches, in this case, four switches $S_1$, $S_2$, $S_3$ and $S_4$ are disposed in a parallel circuit relationship and have one terminal connected to ground and the other terminal connected to respective output terminals *22a*, *22b*, *22c* and *22d* and are also repectively connected to a positive terminal E of a DC source through individual resistors $R_1$, $R_2$, $R_3$ and $R_4$.

In the arrangement of FIG. 3, the switches $S_1$, $S_2$, $S_3$ and $S_4$ form respective bits of a binary number having four bit positions and can be selectively closed and opened to form predetermined data. Assuming that a building served by an associated elevator car includes ten floors, the switches $S_1$ and $S_3$ may be put in their closed position while the switches $S_2$ and $S_4$ are put in their open position. Under these circumstances, a zero voltage level is developed at each of the output terminals *22a* and *22c* while voltages as determined by the resistors $R_2$ and $R_4$ are developed at the output terminals *22b* and *22d*. In other words, an L level, and H level, an L level, and an H level are respectively imparted to the output terminals *22a*, *22b*, *22c* and *22d*.

Then, those signals are entered into the central processing unit 10 to form a binary number [1010] or a decimal number 10. That binary or decimal number designates the tenth floor.

Similarly, the ordinal numbers of the remaining floors can be designated by binary numbers formed of different combinations of closed switch or switches and open switch or switches.

If desired, a length of jumper wire may be substituted for each switch $S_1$, $S_2$, $S_3$ or $S_4$. In such a case, the lengths of jumper wire are selectively connected to and disconnected from an associated common DC source in a predetermined manner to designate the ordinal number of floors. In short, it is only required to combine ON and OFF signals from a plurality of control elements such as the switches or lengths of jumper wire in a predetermined manner.

In the normal mode of the operation, the arrangement of FIG. 1 controls the elevator's appliances 24 in the same manner as conventional elevator control systems excepting that data previously stored in a single ROM device are divided into those stored in the ROM device 16 and those set by the setting device 22.

Upon the occurrence of a failure of the second ROM device 16, a spare can readily be substituted for the failed ROM device 16 because it is common to other elevator cars. This results, as a matter of course, in a far shorter inoperative time interval of the elevator car and accordingly, in a lesser influence on persons utilizing that elevator car.

In the arrangement of FIG. 1, however, the occurrence of a failure on the setting device 22 comes in question, but the setting device 22 has a far smaller probability of occurrence of failures as compared with the second ROM device 16 because the same is formed of a plurality of simple control elements, such as switches or lengths of jumper wire connected to or disconnected from the associated DC source in order to provide ON or OFF signals.

Apart from the problem of failures, however, the setting device 22 includes the switches or lengths of jumper wire whose number is limited in view of its mounting.

Regarding the construction thereof, the setting device (22) will now be described.

It is now assumed that although most elevator systems must be arranged to be capable of serving buildings having at most fifty floors at which the elevator cars involved stop, the systems serve those having from three to ten floors. In the assumed conditions, the setting device 22 is required to provide data including at least six bits provided that the same determines all the floors at which the elevator cars stop. This is because the number fifty, indicating the number of the floors, is greater than $2^5$ and smaller than $2^6$. However, when the ordinal numbers of the floors are stored in the second ROM device 16, except for numbers from the third to the tenth floors, while only those numbers of the latter floors are set by the setting device 22, the device 22 is only required to provide 3-bit data.

Under these circumstances, the central processing unit 10 can first determine if the ordinal numbers of the floors are stored in the second ROM device 16. If so, the central processing unit 10 can read out from the second ROM device 16 that ordinal number of the floor at which the elevator car is required to stop. On the contrary, if the ROM device 16 does not have the ordinary number of the floor stored therein, as determined by the central processing unit 10, then the setting device 22 is arranged to set the ordinary number of the floor at which the elevator car is required to stop. It is noted here that when the central processing unit 10 sees that the ROM device 16 has a cardinal number "0" for the floors entered thereinto, the central processing unit 10 determines that the ordinal numbers of the floors are not stored in the ROM device 16. This is because the floor having a number "0" cannot exist.

From the foregoing, it is seen that the setting device 22 and the second ROM device 16 can be constructed so that the setting device 22 sets data having values lying within a predetermined range and the second ROM device 16 has stored therein data having values lying outside of the predetermined range.

This measure can decrease the number of the switches or lengths of jumper wire included in the setting device 22 and also standardize associated programs.

As described above, the present invention provides an elevator control system with an electronic computer comprising an ROM device for storing control data common to general elevator cars and a setting device including a plurality of control elements for providing ON and OFF signals and setting control data peculiar to a mating one of the elevator cars by different combinations of those ON and OFF signals.

The present invention has several advantages. For example, the ROM device can be standardized and therefore, upon the occurence of a failure of the ROM device, the inoperative time interval of an associated elevator car can be as short as possible. Also, it is possible to manufacture the elevator control system more cheaply than conventional elevator control systems having an electronic computer.

The present invention is economical and effective in view of service as compared with the prior art practice and including an ROM device for storing the number of floors served by an associated elevator car.

While the present invention has been illustrated and described in conjunction with a single preferred embodiment thereof, it is to be understood that numerous changes and modifications may be resorted to without departing from the spirit and scope of the present invention. For example, while the present invention has been described in conjunction with ten served floors being set in the setting device and having the magnitude of 40 stored in the second ROM device to indicate a specified door opening time, it is to be understood that the present invention is not restricted thereby or thereto.

TABLE I

| STEP | |
|---|---|
| 40 | |
| 42 | STORE "NFLR" IN RAM |
| 44 | STORE "DTIME" IN RAM |
| 46 | STORE "DOPEN", "DCLSE", "RUN", "UP" & "DOWN" IN RAM |
| 48 | SET N EQUAL TO 1 |
| 50 | STORE "CAR(N)" & "CALL(N)" IN RAM |
| 52 | IS N EQUAL TO "NFLR" ? |
| 54 | ADD 1 TO N |
| 55 | IS "DOPEN" EQUAL TO 1 ? |
| 56 | IS COUNT ON TIMER EQUAL TO ? |
| 58 | SET COUNT ON TIMER TO "DTIME" |
| 60 | SET COMMAND CLOSURE-OF-DOORS SIGNAL "CLDR" EQUAL TO 1 |
| 62 | SUBTRACT 1 FROM COUNT |
| 64 | IS "DCLSE" EQUAL TO 1 ? |
| 66 | SET "DLDR" EQUAL TO 0 |
| 68 | IS CAR TRAVELING ? |
| 70 | SET N EQUAL TO 1 |
| 72 | IS "CAR(N)" EQUAL TO 1 ? |
| 74 | IS N EQUAL TO "NFLR" ? |
| 76 | ADD 1 TO N |
| 78 | SET STOPPING SIGNAL "STOP" EQUAL TO 1 |
| 80 | IS CAR PRESENT AT 1ST FLOOR ? |
| 82 | IS CAR IN DOWN DIRECTION ? |
| 84 | IS CAR PRESENT AT HIGHEST FLOOR ? |
| 86 | IS CAR IN DOWN DIRECTION ? |
| 88 | SET "STOP" EQUAL TO 0 |
| 90 | DELIVER COMMAND CLOSURE-OF-DOORS & STOPPING SIGNALS |

What is claimed is:

1. An elevator control system for controlling an elevator car and having an electronic computer, said system comprising, a ROM device having stored therein first control data common to all elevator cars, and a setting device disposed separately from said ROM device and including a plurality of control elements, each of said control elements selectively providing one of either an ON or an OFF signal, said setting device setting second control data peculiar to said elevator car by combining said ON and OFF signals from said plurality of control elements.

2. An elevator control system as recited in claim 1, wherein each of said control elements comprises a switch which is selectively placed in one of either closed or open positions to selectively provide said ON and OFF signals.

3. An elevator control system as recited in claim 1, wherein each of said control elements comprises a length of jumper wire which is selectively either connected to or disconnected from a common DC source to selectively provide said ON and OFF signals.

4. An elevator control system as recited in claim 1, wherein said setting device sets said second control data having values lying within a predetermined range and said ROM device has further stored therein said first control data having values lying outside of said predetermined range.

* * * * *